US010816001B2

(12) United States Patent
Klaus et al.

(10) Patent No.: US 10,816,001 B2
(45) Date of Patent: Oct. 27, 2020

(54) COMPRESSOR SYSTEM WITH INTERNAL AIR-WATER COOLING

(71) Applicant: GARDNER DENVER DEUTSCHLAND GMBH, Bad Neustadt (DE)

(72) Inventors: Frank Georg Klaus, Zell-Barl (DE); Ulrich Thomes, Kuelz (DE); Marc Schiel, Heinzenbach (DE)

(73) Assignee: GARDNER DENVER DEUTSCHLAND GMBH, Bad Neustadt (DE)

( * ) Notice: Subject to any disclaimer, the term of this patent is extended or adjusted under 35 U.S.C. 154(b) by 214 days.

(21) Appl. No.: 15/950,098

(22) Filed: Apr. 10, 2018

(65) Prior Publication Data

US 2018/0291904 A1 Oct. 11, 2018

(30) Foreign Application Priority Data

Apr. 10, 2017 (DE) ..... 10 2017 107 602

(51) Int. Cl.
*F04C 29/04* (2006.01)
*F04C 29/12* (2006.01)
(Continued)

(52) U.S. Cl.
CPC ..... *F04C 29/04* (2013.01); *F01C 21/007* (2013.01); *F04C 28/08* (2013.01); *F04C 29/047* (2013.01);
(Continued)

(58) Field of Classification Search
CPC ..... F04C 29/04; F04C 29/047; F04C 29/12; F04C 29/20; F04C 18/16; F04C 2270/20;
(Continued)

(56) References Cited

U.S. PATENT DOCUMENTS 4,212,599 A 7/1980 Lantermann
4,362,462 A 12/1982 Blotenberg
(Continued)

FOREIGN PATENT DOCUMENTS

DE 1628835 A 6/1971
DE 2909675 C3 9/1980
(Continued)

OTHER PUBLICATIONS

Konka, "Schraubenkompressoren Technik und Praxis," VDI-Verlag GmbH, Düsseldorf, 1988, pp. 250-251, pp. 322-335, see pp. 332 et seq.; (statement of relevance included).

*Primary Examiner* — Charles G Freay
(74) *Attorney, Agent, or Firm* — Michael Best & Friedrich LLP

(57) ABSTRACT

A compressor system (01) with a system housing (02), in which are arranged heat generating system components (06) comprising at least one compressor stage (201) for compressing a gaseous medium, an air water cooler (12), a blower (15) which generates a cooling air flow (16), and air conducting elements. A cooling air channel (07) is configured which has an inlet opening (08) in the upper section of the system housing (02) and an outlet opening (09) in the lower section of the system housing (02), wherein upper air conducting elements (13) are positioned in order to conduct the cooling air flow (16) after flowing through the air water cooler (12) to the inlet opening (08), and lower air conducting elements (17) are positioned in order to conduct the cooling air flow (16) from the outlet opening (09) to the system components (06).

9 Claims, 6 Drawing Sheets

(51) Int. Cl.

| | |
|---|---|
| ***F01C 21/00*** | (2006.01) |
| ***F04C 28/08*** | (2006.01) |
| ***F04C 29/06*** | (2006.01) |
| *F04C 18/16* | (2006.01) |

(52) U.S. Cl.
CPC ..... *F04C 29/063* (2013.01); *F04C 29/12* (2013.01); *F04C 18/16* (2013.01); *F04C 2240/30* (2013.01); *F04C 2270/20* (2013.01)

(58) Field of Classification Search
CPC .... F04C 2270/30; F01C 21/007; F04B 39/06; F04D 29/5806; F04D 29/582; F04D 29/5826; F04D 29/584
See application file for complete search history.

(56) References Cited

U.S. PATENT DOCUMENTS

| | | | | |
|---|---|---|---|---|
| 4,929,161 | A * | 5/1990 | Aoki | F04C 29/04 418/101 |
| 6,068,447 | A | 5/2000 | Foege | |
| 6,095,194 | A | 8/2000 | Minato et al. | |
| 6,210,132 | B1 | 4/2001 | Shiinoki et al. | |
| 6,302,236 | B1 | 10/2001 | Choyce | |
| 6,345,960 | B1 * | 2/2002 | Persson | A01J 11/16 417/313 |
| 6,595,757 | B2 | 7/2003 | Shen | |
| 6,739,841 | B2 | 5/2004 | Nishimura et al. | |
| 6,802,696 | B1 | 10/2004 | Verhaegen | |
| 7,118,348 | B2 | 10/2006 | Dean et al. | |
| 7,708,538 | B2 * | 5/2010 | Kawabata | F04C 18/16 418/83 |
| 8,241,009 | B2 | 8/2012 | Platteel et al. | |
| 8,616,856 | B2 * | 12/2013 | Matsuzaka | F04B 39/062 417/228 |
| 8,734,126 | B2 * | 5/2014 | Nishimura | F01C 21/007 417/243 |
| 9,328,731 | B2 * | 5/2016 | Yabe | F04C 29/04 |
| 2004/0101411 | A1 | 5/2004 | Nichol et al. | |
| 2006/0204371 | A1 | 9/2006 | Rexhauser et al. | |
| 2006/0280626 | A1 * | 12/2006 | Nishimura | F01C 21/007 417/410.4 |
| 2007/0189905 | A1 | 8/2007 | Dinsdale et al. | |
| 2007/0212229 | A1 | 9/2007 | Stavale et al. | |
| 2009/0304522 | A1 | 12/2009 | Lelong et al. | |
| 2010/0303658 | A1 * | 12/2010 | Ito | F01C 21/007 418/9 |
| 2013/0039737 | A1 | 2/2013 | Huberland et al. | |
| 2013/0136643 | A1 | 5/2013 | Yabe et al. | |
| 2015/0337845 | A1 | 11/2015 | Wenzel | |
| 2016/0097389 | A1 * | 4/2016 | Yamazaki | F01C 21/007 417/410.5 |
| 2016/0319809 | A1 | 11/2016 | Huetter | |
| 2017/0321699 | A1 * | 11/2017 | Kawano | F04C 29/04 |
| 2018/0030984 | A1 | 2/2018 | Sato et al. | |

FOREIGN PATENT DOCUMENTS

| | | | |
|---|---|---|---|
| DE | 2737677 | C2 | 5/1984 |
| DE | 9014888.6 | U1 | 1/1991 |
| DE | 69818687 | T2 | 4/2004 |
| DE | 69920997 | T2 | 3/2006 |
| DE | 60117821 | T2 | 11/2006 |
| DE | 102006020334 | A1 | 10/2007 |
| DE | 10003869 | C5 | 11/2007 |
| DE | 102014107126 | A1 | 11/2015 |
| DE | 102016100140 | A1 | 7/2017 |
| EP | 0243559 | A1 | 11/1987 |
| EP | 1703618 | A1 | 9/2006 |
| EP | 1934476 | B1 | 7/2009 |
| EP | 2886862 | A1 | 6/2015 |
| FR | 2713702 | A1 | 6/1995 |
| JP | H03-108818 | U | 11/1991 |
| JP | 2008133811 | A | 6/2008 |
| WO | 2011130807 | A2 | 10/2011 |
| WO | WO 2012/026317 | * | 3/2012 |
| WO | 2016129366 | A1 | 8/2016 |

* cited by examiner

| | | |
|---|---|---|
| motor speed | max | |
| volume flow | max | |
| output | [KW] | 150 |
| pressure ratio incorporated | | 3.2 |
| speed ratio | | 1.4 |
| pressure (bar absolute) | max | 12.0 |
| pressure (bar absolute) | min | 6.0 |
| Temp | °C | 35 |
| Pressure (bar absolute) design | | 10.2 |
| Temp | °C | 180 |
| Speed 2nd stage | [1/min] | 22,000 |
| Temp | °C | 30 |
| Pressure (bar absolute) | | 3.2 |
| Temp | °C | 170 |
| Speed 1st stage | [1/min] | 15,500 |
| Pressure (bar absolute) | | 1.0 |
| Pressure (bar absolute) | | 1.0 |
| Temp | °C | 20 |

| | | |
|---|---|---|
| motor speed | min | |
| volume flow | min | |
| output [KW] | | 7 |
| pressure ratio incorporated | | 3.2 |
| speed ratio | | 3.0 |
| pressure (bar absolute) | max | 1.2 |
| pressure (bar absolute) | min | 1.0 |
| Temp °C | | 30 |
| Pressure (bar absolute) design | | 1.2 |
| Temp °C | | 70 |
| Speed 2nd stage [1/min] | | 7,500 |
| Temp °C | | 30 |
| Pressure (bar absolute) | | 1.5 |
| Temp °C | | 90 |
| Speed 1st stage [1/min] | | 2,500 |
| Pressure (bar absolute) | | 1.0 |
| Pressure (bar absolute) | | 1.0 |
| Temp °C | | 20 |

COMPRESSOR SYSTEM WITH INTERNAL AIR-WATER COOLING

CROSS-REFERENCE TO RELATED APPLICATIONS

This application claims priority to German Patent Application No. DE102017107602.6, filed with the German Patent Office on Apr. 10, 2017, the contents of which are hereby incorporated in their entirety.

BACKGROUND

The invention relates to a compressor system with an internal air-water cooling. In particular, the invention relates to a screw compressor arrangement with internal air-water cooling, wherein the novel cooling concept is supported by using a changed idle operating state. Finally, the invention relates to a compressor system with internal air-water cooling, which in addition uses an adjusted pulsation damper, in order to minimize especially noise emissions.

A variety of designs are known for the compression of gaseous media, in particular for the generation of compressed air. For example, DE 601 17 821 T2 shows a multi-stage screw compressor with two or more compressor stages, wherein each compressor stage comprises a pair of rotors for compression of a gas. In addition, two or more drive means with variable speed are provided, wherein each drive means drives a respective compressor stage. A controller controls the speeds of the drive means, wherein the torque and speed of each drive means are monitored so that the screw compressor provides gas at a required flow delivery rate and at a required pressure and is simultaneously supposed to minimize the energy consumption of the screw compressor.

EP 2 886 862 A1 describes a compressor with a motor, a drive shaft, a crank drive connected to said drive shaft, at least one compressed air generation device, a crank case and a compressed air storage container. The cooling of all components occurs with the help of a cooling air flow generated by a fan wheel.

EP 1 703 618 B1 shows a compressor system for providing a compressed gaseous fluid. The compressor system comprises a heat exchanger for direct or indirect cooling of the gaseous fluid, and an air-cooled electromotor, which has a motor unit with a motor housing, from which a drive shaft protrudes. A compressor is driven by the motor unit. In addition, a fan is driven by the drive shaft, said fan comprising at least radially and/or axially separate first and second fan sections for transporting of a first air flow as well as a further second air flow separate from the first air flow. In addition, a channel separation is provided on the upstream side, which separates a first inlet channel for the first air flow from a second inlet channel for the second air flow, wherein the first air flow is suctioned from the first fan section and the second air flow is transported by means of the second fan section. The air flows enter over spatially separated cross-sections into the respective associated fan sections and exit them again without mixture. The second air flow is conducted via the heat exchanger (25). The heat exchanger is arranged with respect to the second air flow upstream of the fan.

In general, with such compressor systems there is always the need to dissipate more or less great quantities of heat, in order to prevent an overheating of individual components or of the entire system. The entire system has thus far been cooled by means of cool air, wherein heated exhaust is emitted. Some systems additionally contain a heat exchanger, whose secondary cooling medium absorbs heat from a primary cooling circuit of the compressor and transports it outside. The dissipated heat can then be used by an external consumer by way of heat recovery. All systems have in common the problem that air and exhaust openings are necessary for the circulation of cooling air, said openings which let sound escape from the compressor system, so that expensive sound protection measures are required. In addition, the supply of cooling air can lead to damages in the system, for example due to accruing dirt or to the condensation of humidity, which can lead to corrosion. These two primary problems arising from the necessity of cooling air ventilation are further increased by the components used there and the functionality.

Thus, additional sound emissions occur, in particular in the case of machines working in accordance with the displacement principle. There the problem exists that due to the intermittent exhaust process on the pressure or exhaust side of the compressor, in the downstream components, such as for example pipelines, coolers, pressure vessels etc., unwanted pulsations, i.e. pressure changes occur, which cause considerable noise emissions, based on structure-borne noise, sound transmission and noise emission. Since the exhaust operations are pulsed operations, the harmonics of the pulsation base frequency are also more pronounced, in some cases even stronger than the base frequency itself.

From DE 699 20 997 T2 a pulsation damper for a pump is known for the singular solution of the problems triggered by pulsations, which comprises a device body and a membrane, wherein the membrane divides an interior of the device body into a fluid chamber, which can temporarily store a fluid to be transported through a piston pump, and a gas chamber, which is filled with a gas for the suppression of pulsations and expands and contracts, in order to alter a capacity of the fluid chamber. As a result of this, pulsations due to an output pressure of the liquid to be transported are damped.

In practice, simple pulsation dampers are also known, which are essentially formed in the manner of a long extended pipe with absorber materials mounted in the interior, and are aimed at damping both by absorption and reflection of the sound. However, these known sound dampers have several disadvantages. First, a great length of the absorber portion is critical for achieving a sufficient damping. Since the absorber materials employed show a constant damping over the length, the sound damping occurs gradually from entry into the damper to the exit, which, as a result means that in the entry region of the sound damper relatively speaking, a great deal of sound is emitted via the housing to the outside. Moreover, in particular in the case of high frequencies the sound penetrates the long extended damper tube, so that specified frequencies of the pulsations can pass the absorber virtually undamped.

A heat development not to be neglected also occurs in a compressor system while idling, so that this heat must be taken into consideration in the dimensioning of the cooler. Thus, in practical use, in particular in the case of multi-stage screw compressors while idling, when no compressed air is being taken from the downstream system, the transport of additional medium is stopped to avoid a pressure increase. However, the compressor should not be completely shut off while idling, if, on short notice a necessary subsequent delivery of compressed air is to be expected. In order to facilitate this idling operation, usually a throttle valve is closed in the suction line and only a partial flow of the first compressor stage is supplied via a bypass. In most cases a so-called suction regulator carries out these functions, said suction regulator being arranged on the inlet of the first compressor stage. Simultaneously, on the output side, thus on the output of the second compressor stage, an exhaust valve opens to the atmosphere, so that the second compressor stage transports against atmospheric pressure. The pressure conditions in both compressor stages remain unchanged, as a result of which the discharge temperatures of both stages remain nearly the same. The high energy consumption of the compressor and the exiting waste heat are among the disadvantages of this idle control.

SUMMARY

Hence, a first problem addressed by the invention is that of providing a compressor system with an improved cooling, which avoids the disadvantages of the supply of large quantities of ambient air as cooling air. In so doing, the invention also aims to facilitate the recovery of the waste heat of the compressor system. Likewise, the invention addresses the problem of reducing noise emission and energy consumption of the compressor system.

The mentioned problem is solved by a compressor system according to the attached claim 1. Preferred embodiments are mentioned in the subsidiary claims.

The inventive compressor system has a system housing in which several heat generating system components are arranged. These comprise at least one compressor stage, for example a double screw compressor with two compressor stages, which compress a gaseous medium, in particular generating compressed air. The system housing additionally contains an air water cooler, a blower, which generates a cooling air flow, as well as air conducting elements, which guide the air heated by the system components to the air water cooler. At least one cooling air channel is configured in the system housing, said cooling air channel having an inlet opening in the upper segment of the system housing and an outlet opening in the lower segment of the system housing. Upper air conducting elements are positioned in the system housing in order to conduct the cooling air flow to the inlet opening of the cooling air channel by flowing through the air water cooler. In addition, lower air conducting elements are positioned in order to conduct the cooling air flow from the outlet opening of the cooling air channel to the system components generating heat.

Usually there are numerous system components in the system housing that heat up during operation. Among these, depending on the design of the compressor system there are for example an air-cooled drive motor, pipes and pipelines, a pulsation damper, an oil pan, the actual compressor with several compressor stages if necessary, gear stages etc. Heat also develops through electronic components which are usually combined in a switch cabinet, which in one preferred embodiment can likewise be integrated in the system housing.

For the purpose of cooling the interior in the system housing a cooling air flow is conducted there, which dissipates the heat from the system components. In contrast to the prior art, this cooling air flow is not dissipated outside through housing openings, but rather is purposefully conducted to the air water cooler within the housing.

In the air water cooler a water circuit provides for the cooling of the air. The cooled air is conducted through the cooling air channel and from there distributed and purposefully supplied to the system components to be cooled.

Numerous advantages arise from the proposed design of the inventive compressor system. For example, no openings are necessary in the system housing to suction large quantities of cooling air and emit into the surroundings. As a result, the compressor system emits a low sound level, causing the requirements to be fulfilled on site in the installation area to be simplified. In addition, due to the virtually complete supply of the waste heat to the air water cooler, approximately 97% of the accruing compressor waste heat is transferred to the cooling water and supplied to a heat recovery system. Due to the to a large extent lacking absorption of cooling air from the outside the ambient conditions have less of an effect on the compressor system, so that setting up the compressor system in outside regions or in particularly demanding environments is less difficult. The thermal state of the compressor system is determined virtually exclusively by the conditions of the cooling water supplied to the air water cooler from the outside. In this way a heating of the compressor system is even possible in the case of shutdown (frost protection), by having the external water circuit transfer heat via the cooling water to the internal air water cooler and thus convey warm air through the compressor system. In addition, problems that can arise from soiled air or ambient air that is too damp are avoided.

The proposed structure of the compressor system and the integrated ventilation concept realized with it can be used with all types of compressor system (oil injected, water injected) in which a water cooling system is used for cooling the heat arising at the compressor stages. The heat in the system interior is supplied to the water cooling system.

According to one preferred embodiment the air water cooler is provided by the same external cooling circuit that is used for the water cooling of the compressor stage of the compressor system. The air water cooler can in the process be connected in series or parallel with the cooling circuit of the compressor stage.

One preferred embodiment of the compressor system is characterized by the fact that the air water cooler is positioned above the heat generating system components, and that the blower is positioned above the air water cooler in order to suction the cooling air flow through the cooler and supply it to the inlet opening of the cooling air channel. The waste heat accruing through operation automatically rises upward, so that the air conduction elements can be limited to small guide plates. Preferably the air conducting elements are formed by the section of the inner wall of the system housing and/or frame parts, which can also assume the bearing functions.

Particularly expedient is one embodiment, in which the cooling air channel runs at least in sections in or on the door sealing the housing. When opening the door this section is automatically swiveled away, so that the access to the other system components is not hindered. In this way maintenance is easily possible.

In one embodiment the cooling air channel runs in sections in a bottom of the housing and has several outlet openings there, which release the cooling air upward to the housing. Likewise, lateral outlet openings can be provided in the section of the cooling air channel in the door running vertically, if specific system components are supposed to be supplied laterally with cooling air.

In one advantageous embodiment the system housing is to a large extent hermetically sealed from the environment. The cooling air flow circulates then virtually exclusively within the system housing. The compressor stage is in the process of course connected to a suction support opened to the environment, in order to suction the air to be compressed.

In one improved embodiment the heat generating system components comprise an electronic circuit assembly. In this case the circuit assembly is cooled by the cooling air flow circulating within the system housing. As an alternative, the circuit assemblies can be accommodated in a separate switch cabinet which has its own cooling system.

An improved embodiment is characterized by the fact that it additionally comprises a pulsation damper as a system component. The pulsation damper is suitable for damping pulsations and the resulting sound in the gaseous media flow, which is supplied by a compressor. The pulsation damper first has a housing extending along a central axis with a media flow inlet and a media flow outlet. In addition, several sleeve-like absorber elements are provided, which consist of sound-absorbing material and are arranged concentrically to one another in the housing. In this respect the pulsation damper deviates strikingly from known dampers, because in the prior art either only a single absorber element is used or several absorber elements are arranged axially in succession. Each sleeve-like absorber element has an inlet region and an outlet region, which are positioned axially spaced from one another, preferably arranged at the opposing faces of the absorber element. The inlet region of the frontmost absorber element in terms of flow is connected to the inlet region of the subsequent absorber element in terms of flow and so on, and the outlet region of the rearmost absorber element in terms of flow is connected to the media outlet of the damper housing. Between respective radially adjacent wall sections of different absorber elements, in each case a flow chamber remains, through which the media flow is conducted. Through this design, the several absorber elements hence form several stages, which are in nested arrangement to one another. Each of these stages functions more or less as a separate absorber. The media flow changes its direction multiple times in the damper, preferably meandering along the individual absorber elements.

One significant advantage of the pulsation damper consists in the fact that through the nested arrangement of the absorber elements and the resulting meander-like conduction of the media flow the overall installation length is considerably reduced. In the case of comparable damping of the total system, the inventive damper is shorter by more than half than a conventional damper with a straight-line guidance of the media flow. This damper can therefore be integrated into the system housing particularly easily and can be used there to provide heat dissipation with the cooling air flow.

According to one embodiment the absorber elements consist of the same sound-absorbing material so that they all act on the same frequency range. In a modified embodiment the individual absorber elements are coordinated to the damping of different frequency ranges, in particular by using different sound-absorbing materials. Preferably the absorber elements consist of mineral materials, metal or plastic tissue, metal or ceramic foams, wherein chamber-like structures are advantageous. Likewise, multi-layer absorber material coatings can be used.

One preferred embodiment of the pulsation damper uses rotationally symmetrical absorber elements, which engage like a telescope and are arranged axially fixed in the damper housing. However, in modified embodiments the absorber elements can also have a rectangular or polygonal cross-section. It is particularly advantageous if at least three or more absorber elements are arranged annularly to one another, wherein between the inner diameter of a respective external absorber element and the outer diameter of an internal absorber element by way of contrast, in each case a difference remains, in order to configure the flow chamber there, for example with a width of 5-10 mm. The absorber elements preferably extend over virtually the same axial length so that at least 80%, preferably at least 90% of the longitudinal extent of the absorber elements overlaps axially.

According to one embodiment the inlet region and the outlet region of the pulsation damper are each arranged on the fronts of the absorber elements, wherein the flow direction of the media flow in each case undergoes a reversal of direction by 180° in the transition from one absorber element to the next absorber element. Since, due to the nested arrangement of the sleeve-like absorber elements in each case on the transition between the adjacent absorber elements a cross-section increase is available for the media flow (even in the case of a constant gap width in the flow chamber), a reduction of the flow speed occurs, as a result of which an additional damping is achieved. Depending on the design, twice the amount of penetrated cross-sectional area and with it also a distinct speed reduction from one stage to the next can be easily achieved. Likewise, the reversal of direction in the overlap of the media flow from one absorber element to the next can be positively exploited for the improvement of the damping properties, because due to the redirections there is no direct "line of sight" between the media flow inlet and the medial flow outlet, which prevents a direct "transmission" of pulsations of higher frequencies to downstream components.

Through the use of sleeve-like absorber elements with annular flow chambers remaining between them generous cross-sections for flow conductance of the media flow can be achieved, resulting in the lowest pressure losses.

One advantageous embodiment is characterized by the fact that the frontmost absorber element of the pulsation damper in terms of flow is arranged radially internally and the rearmost absorber element in terms of flow is arranged radially outward. Preferably, the damper housing has an absorber element receiving region with a circular cross-section; a front plate, on which the media inlet is configured as a central inlet opening, which flows into a central inlet region of the frontmost absorber element in terms of flow; and a flange, which faces the front plate, forms the media outlet and into which an annular outlet region of the rearmost absorber element in terms of flow flows. Since in this design the media inlet to the damper is located in the inner region, the site with the greatest sound energy is there, i.e. far removed from the outer damper housing wall. In a damper equipped with three absorber elements the next stage in flow direction is also still in the interior of the damper. In the last stage, which is formed by the absorber element adjoining the damper housing, the sound energy is then structured such that the sound energy emitted from the damper housing in the interior of the system housing is minimal. Due to the fact that ventilation openings are no longer required in the system housing the sound emission generated by the entire compressor system is minimized.

According to one preferred embodiment of the pulsation damper the ratio of axial length to maximum cross-section extent (e.g. diameter) of each absorber element is less than 5, preferably less than 2.5.

Especially preferably this ratio in the radially outmost absorber element is less than 1, preferably less than 0.75. Likewise, it is advantageous if the ratio of axially outward overall length of the pulsation damper to the length of the path traveled by the media flow through the absorber element is less than 1, preferably less than 0.5.

One improved embodiment of the pulsation damper is characterized by the fact that one or more of the absorber elements have additional hollow spaces which act as resonator chambers. The resonator chambers extend preferably angularly to the flow chambers and serve the purpose of additional pulsation and sound damping using reflection and resonance effects.

It is evident that the cooling realized in the compressor system does not have to be as efficiently dimensioned with respect to the size of the air water cooler and the efficiency of the blower if the least possible amount of heat dissipation occurs on the system components. Contributing to this is the fact that the least amount of heat accrues in idling operation of the compressor. In the case of a multiple stage screw compressor this happens by means of a changed actuation of the compressor stages, which will be explained in greater detail in the following. The method is thus applicable for an inventive compressor system which works with a screw compressor with at least a first and a second compressor stage, wherein the first compressor stage compresses the gaseous medium and conducts it to the second compressor stage, which further compresses the medium. Thus, viewed in flow direction of the medium, the first compressor stage precedes the second compressor stage. In most cases such screw compressors have precisely two compressor stages; however designs with more than two stages are also possible. In addition, execution of the method requires that both compressor stages are driven separately from one another and speed adjustably, i.e. each compressor stage is driven by a speed adjustable drive, in particular by a direct drive, so that a distribution gear can be dispensed with.

In a first step, a volume flow of the compressed gaseous medium, which is removed at the outlet of the second compressor stage or emitted at the following units, is recorded with a suitable transducer. In the process, a direct volume flow measurement can be used or the removed volume flow is indirectly determined e.g. from the pressure conditions obtaining at the outlet of the second compressor stage or from the torque/drive flow occurring on the drive of the second compressor stage.

In normal load operation a volume flow is removed which can fluctuate between a maximum value, for which the screw compressor is designed, and a predetermined minimum value. In this load operation the screw compressor is regulated in known manner, which includes the fact that the speed of the drives of the two compressor stages can be varied in a predefined range. If the removed volume flow sinks in a range between a maximum value and a predetermined minimum value in load operation, the controller of the compressor system reduces the speed of both compressor stages, and if the volume flow in this range rises, the controller increases the speed of the compressor stages again, so that in normal load operation a predetermined source pressure is maintained.

On the other hand, if the volume flow exceeds the predetermined minimum value, i.e. if no or only a small volume flow is removed, the operating state of the compressor system switches from load operation to idling operation. To this end, in the next step an exhaust valve is opened in order to let the volume flow initially continued from the second compressor stage to escape at least partially via the exhaust valve. This prevents the pressure at the outlet of the screw compressor to exceed a maximum permissible amount. The exhaust valve can for example be a controlled solenoid valve.

In a further step, which preferably is executed with only a slight delay or essentially simultaneously with the opening of the exhaust valve, the speed of at least the first compressor stage is reduced to a predetermined V1L, in order to reduce the volume flow supplied from the first to the second compressor stage. In contrast to the prior art, for this purpose a throttle valve or suction regulator is not closed. Rather, the inlet of the first compressor stage remains completely opened. A throttle valve or suction regulator and its actuator can be completely dispensed with. The reduction of the volume flow supplied from the first compressor stage occurs preferably exclusively via the reduction of the speed of the first compressor stage to the idling speed V1L.

According to one preferred embodiment, in a next step the speed of the second compressor stage is also reduced to an idling speed V2L. Preferably the speeds of both compressor stages are essentially running parallel in each case reduced to the idling speed V1L or V2L.

The idling speed V1L of the first compressor stage (Low Pressure—LP) is selected in coordination with the idling speed V2L of the second compressor stage (High Pressure—HP) such that the discharge temperature of the medium at the second stage is not less than the entry temperature at this stage. Such an inadvertent operating condition can occur when the pressure ratio at the second compressor stage is less than 0.6. Therefore, it should be ensured through the selection of the idling speeds that the second stage does not work as an "expander" and as a result the media temperature sinks. Otherwise, there can be undesirable condensation in the compressor. Furthermore, in the selection of the idling speeds it should be ensured that the second compressor stage is not driven via the transported medium from the first compressor stage, since otherwise the drive of the second stage would change to generator operation, which could lead to damage of the frequency converter controlling it.

The minimum idling speeds are also determined by which delay is acceptable upon reentry into the load state. The shorter this return time must be, the higher the idling speed to be selected.

Preferably the speed ratio in idle between the second and first stage lies in the range of 2 to 3, especially preferably around 2.5. The pressure ratio of the first stage in the process is about 1.5 and the pressure ratio of the second stage lies in the range of 0.6 to 0.75. Preferably the idling speed V2L of the second compressor stage is about ½ ¼ of the load speed of this stage. Preferably the idling speed V1L of the first compressor stage is about ⅕ to ⅛ of the load speed of this stage.

Hence, one advantage of this control method consists in the fact that both compressor stages can be operated in idling operation with significantly lower speeds. This reduces the energy consumption and wear and tear. Moreover, the temperatures of the compressed medium at the outlet of the respective compressor stage drop, which has an advantageous impact on the total amount of the heat accruing in the compressor system. However, the screw compressor can be very rapidly brought back to load operation in the event of a new request for volume flow, by increasing the speeds of the compressor stages again.

BRIEF DESCRIPTION OF THE DRAWINGS

Further advantages and details of the invention arise from the following description of preferred embodiments in reference to the drawing. The figures show the following.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of supporting other embodiments and of being practiced or of being carried out in various ways.

Figure 1:
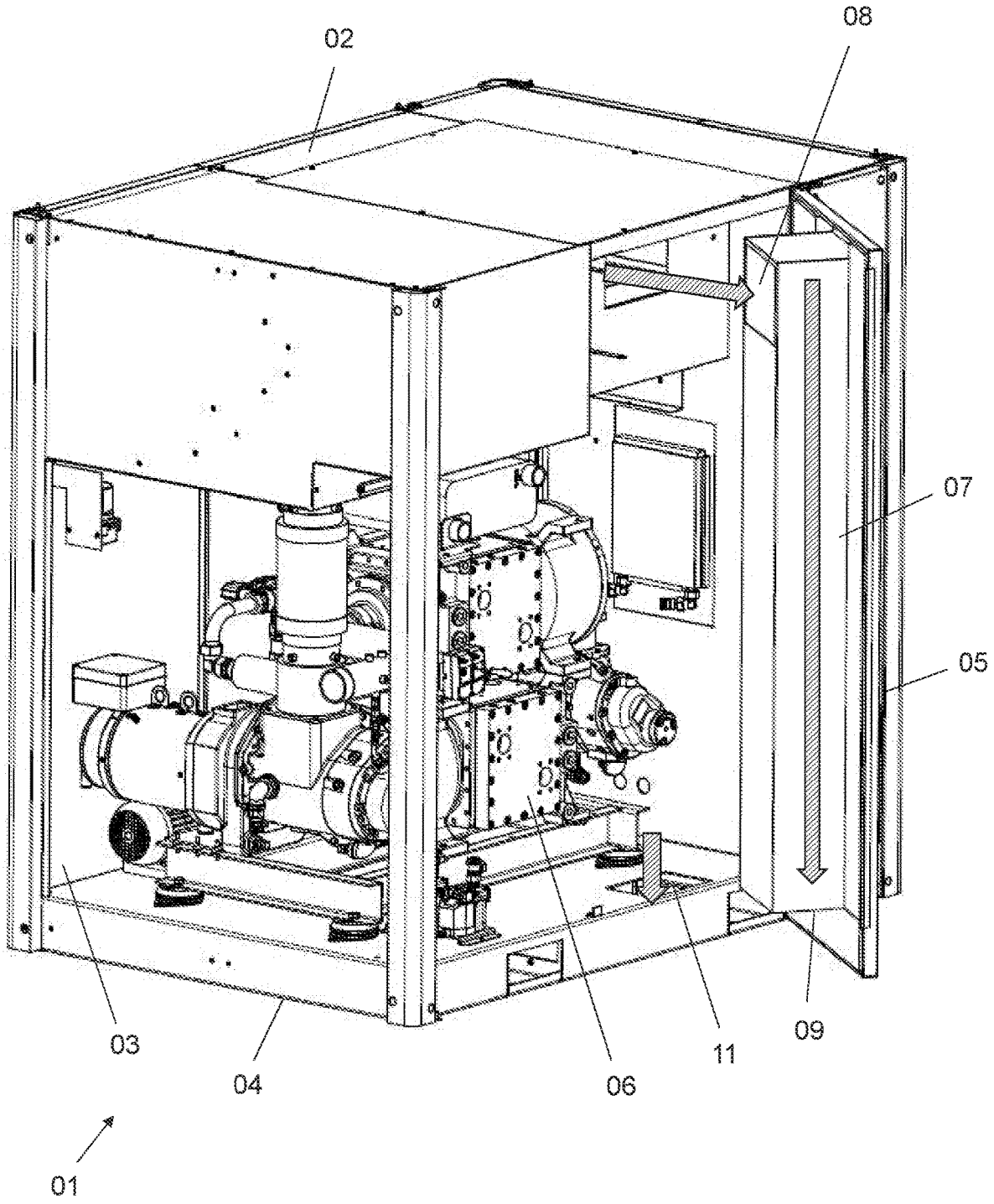
FIG. 1 illustrates a partially opened view of an inventive compressor system.

FIG. 1 shows an inventive compressor system 01 in a partially opened, perspective view. The compressor system 01 has a closable system housing 02 whose sidewalls 03 are only partially shown. The system housing 02 comprises a bottom 04 and a door 05, which permits access to the system components 06 inside. The system components 06 generate heat during the operation of the compressor system and comprise at least one compressor stage for compression of a gaseous medium. The door 05 has a first section of a cooling air channel 07, which has an inlet opening 08 above and an outlet opening 09 on the bottom. A passage 11 is arranged in the bottom 04, which is coupled with the outlet opening 09 when the door 05 is closed in order to allow cooling air to flow into the bottom 04. The cooling air channel 07 is thus composes of the section running in the door, of sections in the bottom as well as sections within the system housing, which e.g. are formed by the air conducting elements.

Figure 2:
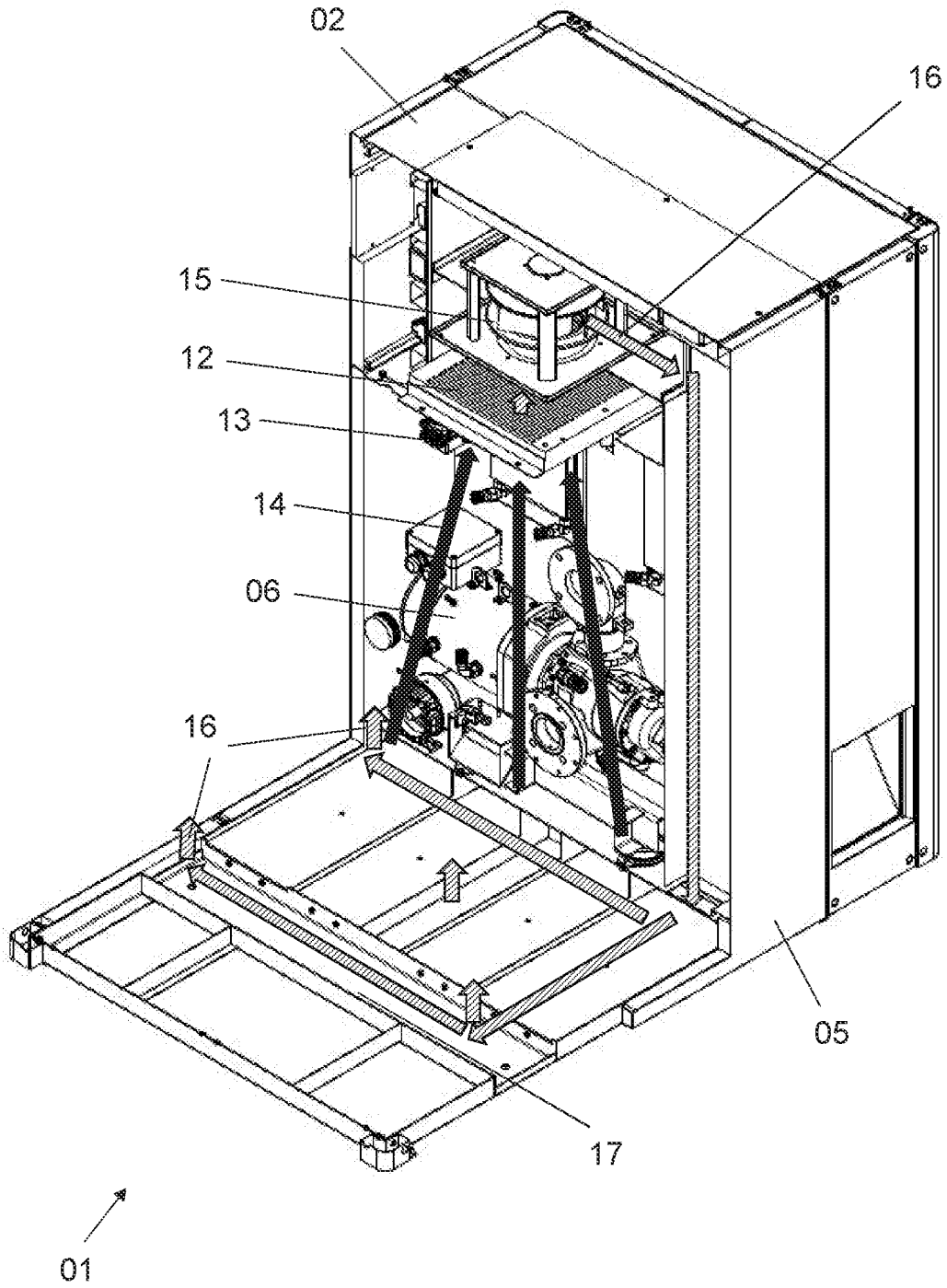
FIG. 2 illustrates a partially sectioned view of the compressor system with an indicated cooling air flow.

FIG. 2 shows the compressor system 01 in an opened view, wherein several of the system components are not shown. As a result, it becomes obvious that in the upper third of the system housing an air water cooler 12 is arranged, which is thus located above the system components 06 generating the heat. Several upper air conducting elements 13 are arranged in the system housing, said air conducting elements conducting the rising, heated air—symbolized by the warm air arrows 14—to the air water cooler 12.

A blower 15 is arranged above the air water cooler 12 for generation of a circulated cooling air flow. Said blower suctions the warm air through the air water cooler 12 and blows the cooled air there as a cooling air flow 16 to the inlet opening 08 of the cooling air channel 07. The cooling air flow 16 is conducted downward in the cooling air channel 07 and exits the outlet opening 09, in order to reach the bottom 04 via the passage 11. Lower air conducting elements 17 are arranged in the bottom 04 and, if necessary, also in the lower section of the system housing, in order to conduct the cooling air flow to the system components 06 to be cooled.

Figure 3:
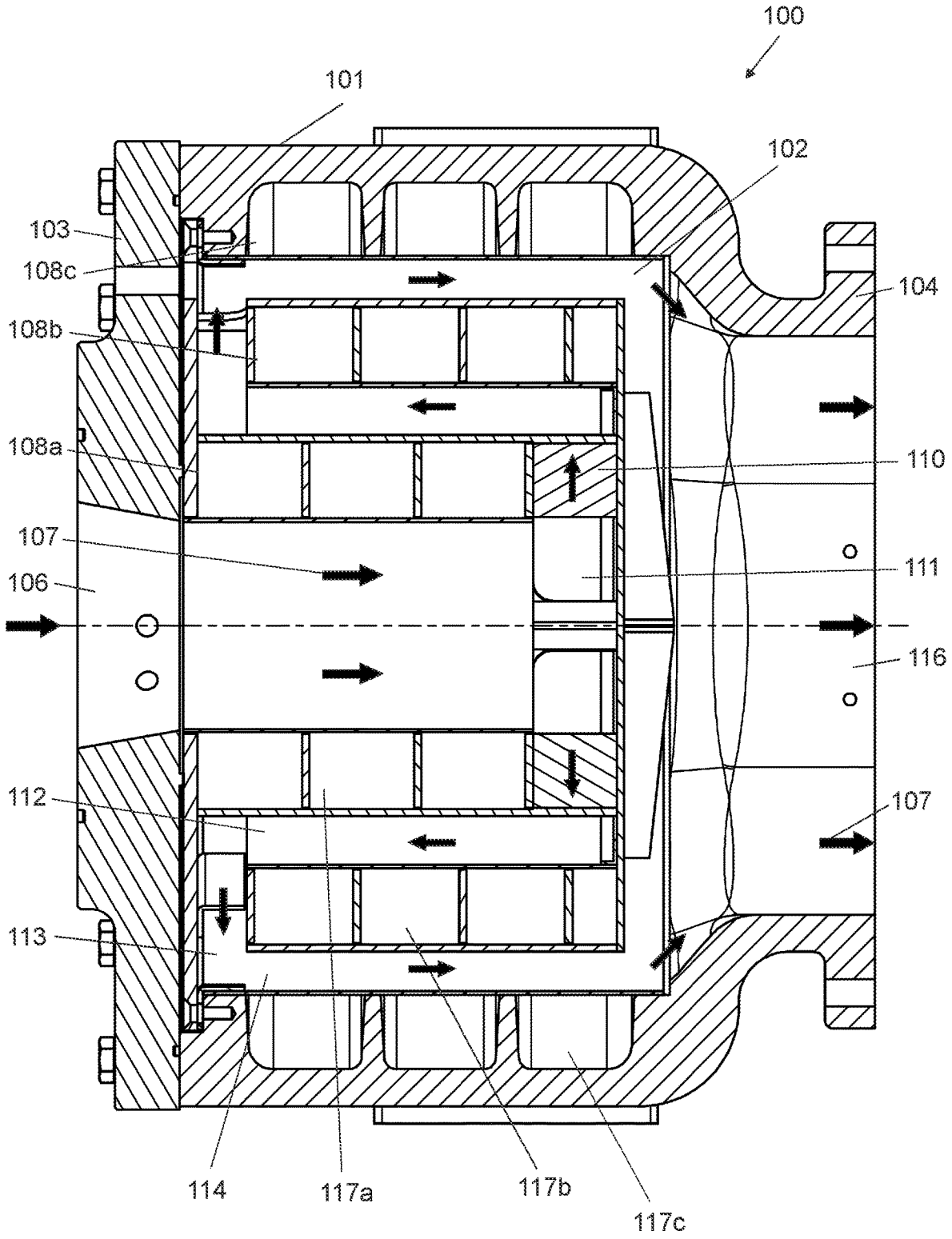
FIG. 3 illustrates a longitudinal section of a pulsation damper which forms a system component.
Figure 4:
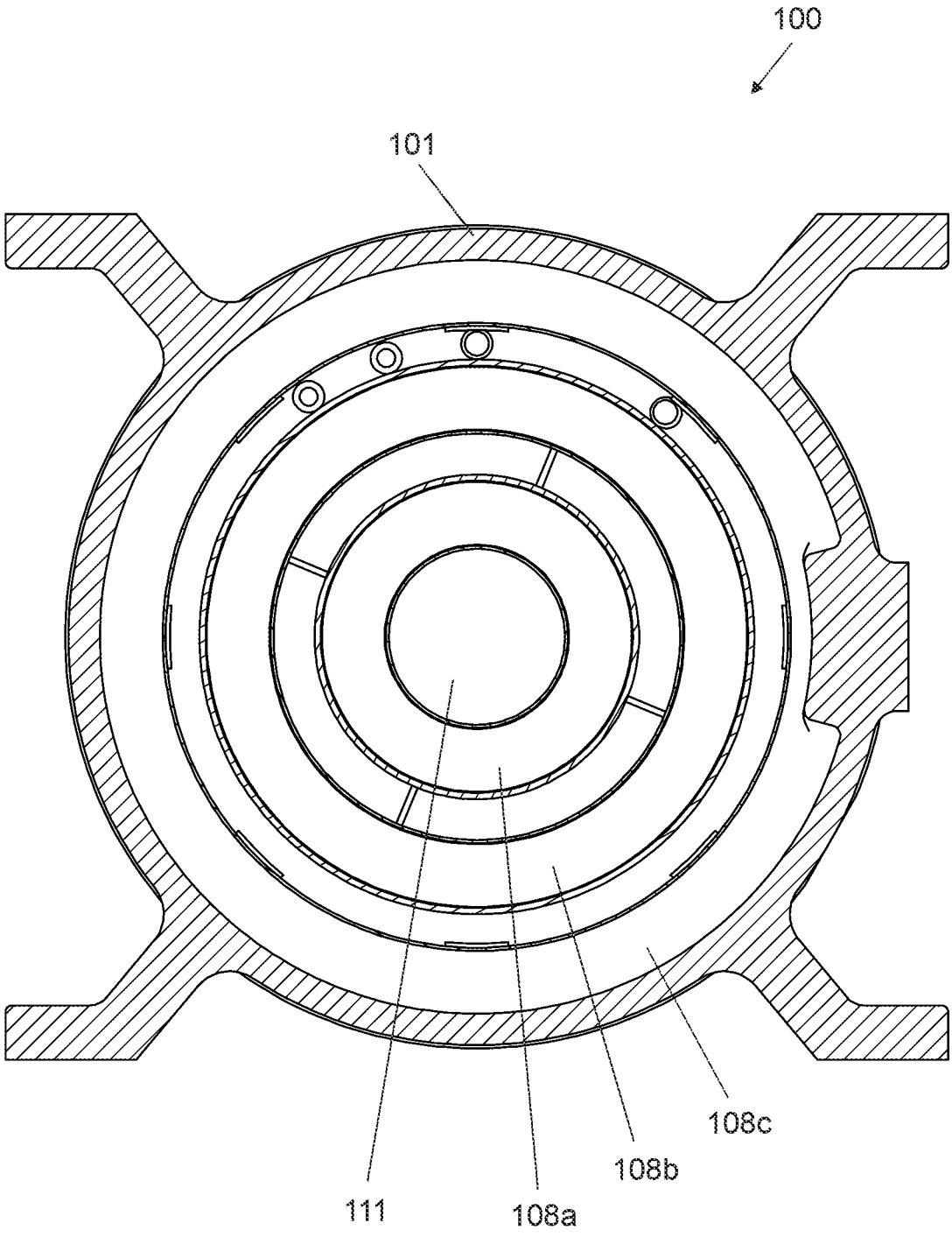
FIG. 4 illustrates a cross-section of the pulsation damper according to FIG. 3.

FIG. 3 shows a simplified longitudinal section view of a pulsation damper 100, which is a system component of the previously described compressor system. FIG. 4 shows the cross-section of this pulsation damper. The sound damper 100 in this example has an essentially cylindrical damper housing 101 with an absorber element receiving region 102, a front plate 103 sealing the damper housing on the front side and a flange 104 axially opposing the front plate. The front plate 103 has a centrally arranged media flow inlet 106, via which a gaseous media flow 107 compressed by a compressor, in particular compressed air, is supplied.

Several sleeve-like absorber elements 108 are arranged in the absorber element receiving region 102, in the example shown a front absorber element 108*a* in terms of flow, a central absorber element 108*b* in terms of flow and a rearmost absorber element 108*c* in terms of flow. The three absorber elements are inserted telescopically into one another and have essentially the same length in axial direction. All absorber elements consist of sound absorbing material, wherein the specific properties of the material can be selected differentiated between the individual absorber elements.

The media flow inlet 106 flows into the centrally located inlet region of the front absorber element 108*a*, so that the media flow first flows in the interior of the front absorber element 108*a* and undergoes a damping through its material. The interior of the front absorber element 108*a* can be hollow or filled with gas-permeable material, wherein the flow resistance is to be kept low. An outlet region is provided on the end of the front absorber element 108*a* averted from the front plate 103 so that the media flow can escape from the front absorber element 108*a*. The media flow flows there in a first annular change region 110 to the inlet region of the central absorber element 108*b*, wherein there is a reversal of direction in the media flow 107. The central absorber element 108*b* annularly encompasses the front absorber element 108*a* in terms of flow, wherein a centering pin 111 provided on the central absorber element 108*b* acts as a fixture for the front absorber element 108*a*. The media flow 107 now flows through a first cylindrical flow chamber 112, which extends in axial direction between the front absorber element 108*a* and the central absorber element 108*b*.

On the end of the central absorber element 108*b* directed toward the front plate 103 the media flow exits the first cylindrical flow chamber 112 via an outlet region and flows in a second annular change region 113 to the inlet region of the rear absorber element 108*c*. Now the media flow 107 flows through a second cylindrical flow chamber 114, which extends in axial direction between the central absorber element 108*b* and the rear absorber element 108*c*. The flow direction in the second flow chamber 114 is axially opposed to the flow direction in the first flow chamber 112.

On the end of the rear absorber element 108*c* in terms of flow averted from the front plate 103 the media flow 107 exits the absorber element receiving region 102 via an outlet region of the rear absorber element 108*c* in terms of flow and then flows through a media flow outlet 116 in the flange 104 to the downstream units of the compressor. It is evident from the figures that the cross-section available for the media flow in each case significantly increases in the change regions and finally is significantly larger on the media flow outlet 116 than on the media flow inlet 106.

It is also evident from the figures that all three absorber elements 108 each have several resonator chambers 117*a*, 117*b* or 117*c* in their walls.

Figure 5:
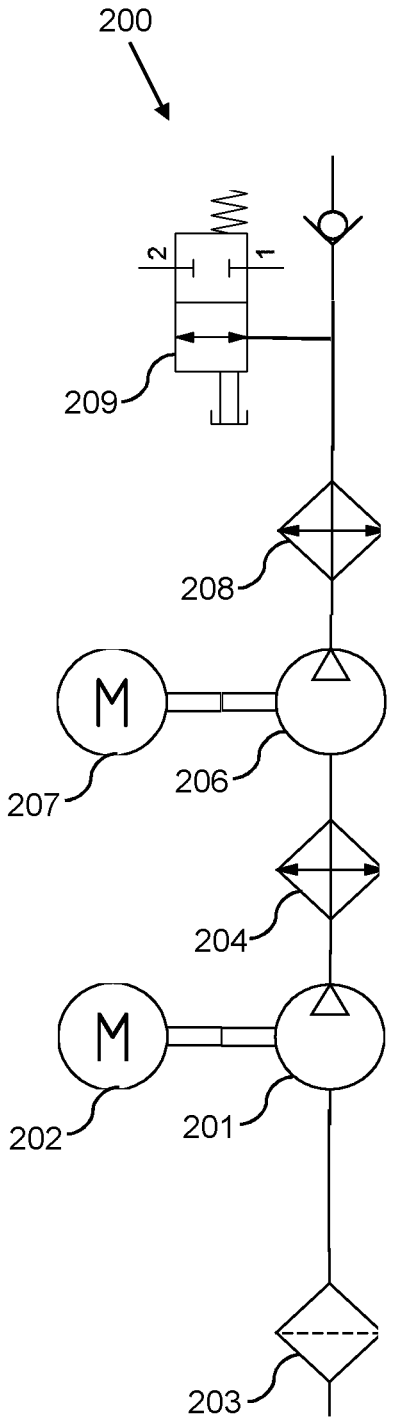
FIG. 5 illustrates a simplified representation of the operating parameters in a screw compressor with two compressor stages during load operation.

FIG. 5 shows the principle structure of a compressor system, which is used as a system component of a twin screw compressor 200. In addition to the individual elements of the twin screw compressor, typical parameters are moreover specified, as they occur in load operation when compressed air is discharged with a volume flow above a predetermined minimum value and not greater than a system-specific maximum value.

A first compressor stage 201 has a first direct drive 202, which is speed controlled. The inlet of the first compressor stage 201, via which ambient air is suctioned, is coupled directly to a suction support 203 without interposition of a suction regulator, said suction support at which there is an ambient atmosphere with a pressure of 1.0 bar at a temperature of e.g. 20° C. Hence, on the inlet of the first compressor stage 201 there is a pressure of 1.0 bar.

The first compressor stage 201 is for example operated at a speed of 15,500 min−1 in order to compress the air. There is a pressure of 3.2 bar then at the outlet of the first compressor stage 201, so that the first compressor stage has a compression ratio of 3.2 in load operation. Due to the compression, the temperature of the medium (compressed air) increases to 170° C. The compressed air is conducted from the outlet of the first compressor stage 201 via an intercooler 204 to the inlet of a second compressor stage 206, which has a second, speed controlled direct drive 207. The heat accruing at the intercooler 204 must be discharged from the compressor system. The air circulating in the system housing 02 is cooled by the air water cooler 12. The cooling water flowing in the air water cooler can be conducted in a parallel branch or in series connection through the intercooler 204, if said intercooler has a water cooler. After the intercooler 204, on the inlet of the second compressor stage 206, the compressed air has a temperature of 30° C. and in addition a pressure of 3.2 bar. In load operation the second compressor stage 206 is operated at a speed of e.g. 22,000 min−1, so that further compression can occur. The compressed air accordingly has a pressure of 10.2 bar and a temperature of 180° C. on the outlet of the second compressor stage 206. Hence, the second compressor stage 206 has a compression ratio of likewise about 3.2. The compressed air is conducted from the outlet of the second compressor stage 206 through an aftercooler 208 and is cooled there to about 35° C. The aftercooler 208 can also be integrated in the cooling water circuit, which supplies the air water cooler 12 and or the intercooler 204. Finally, an exhaust valve 209 is arranged on the outlet of the twin screw compressor 200, said exhaust valve being controlled by a control unit (not shown in the figure).

The twin screw compressor 200 described by way of example shows at a maximum speed of the direct drives 202, 207 a power consumption of 150 kW and supplies compressed air with a maximum pressure of 12 bar and minimum pressure of 6 bar. The speed ratio between the compressor stages is about 1.4 in load operation.

Figure 6:
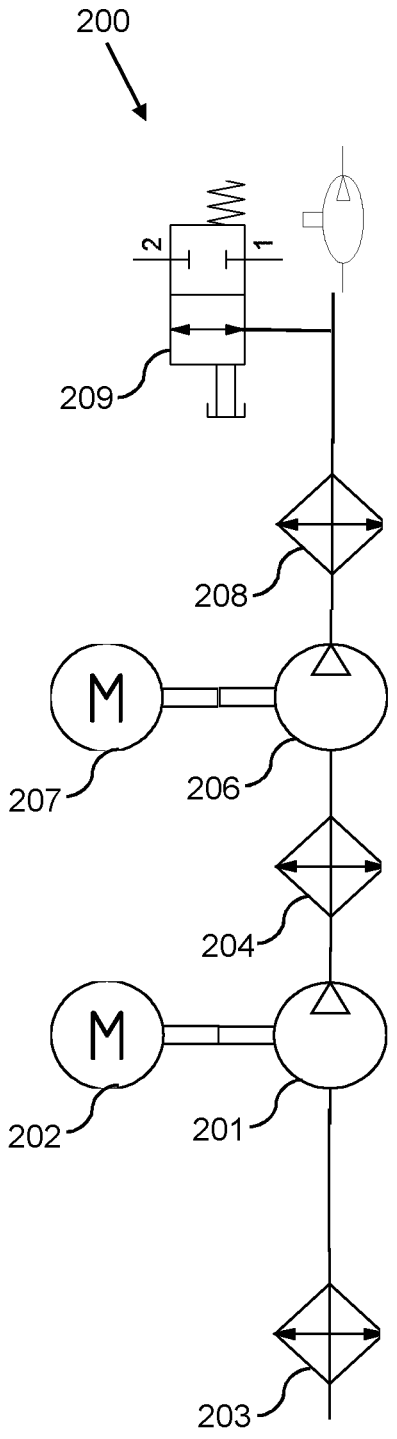
FIG. 6 illustrates a simplified representation of the operating parameters in the screw compressor during idling operation.

FIG. 6 shows the twin screw compressor 200 in idling operation, i.e. when basically no compressed air is being removed. Along with the elements of the twin screw compressor again typical parameters are specified, as they occur in idling operation. In order to enter into idling operation, the exhaust valve is opened and the speed of both compressor stages is reduced. The inlet of the first compressor stage 201, via which in addition ambient air is suctioned, even if in reduced quantity, is directly coupled to the suction support 203 without interposition of a suction regulator, at which there is ambient atmosphere with a pressure of 1.0 bar at a temperature of 20° C. Hence, at the inlet of the first compressor stage 201 a pressure of 1.0 is present, unaltered.

The first compressor stage 201 is now operated with an idling speed V1L=2,500 min−1, in order to compress the air. At the outlet of the first compressor stage 201 then there is a pressure of 1.5 bar, so that the first compressor stage has a compression ratio of 1.5 in idling operation. Through the reduced compression the temperature of the medium (compressed air) only rises to 90° C. The compressed air is conducted from the outlet of the first compressor stage 201 via the intercooler 204 to the inlet of the second compression stage 206. After the intercooler 204, on the inlet of the second compressor stage 206, the compressed air has a temperature of for example 30° C. while idling and in addition has a pressure of 1.5 bar (intermediate pressure). Hence, the necessary cooling capacity for the intermediate cooling is reduced in idling operation. In idling operation the second compressor stage 206 is operated at an idling speed V2L of 7,500 min−1. The compressed air has, in comparison to the intermediate pressure, a lower pressure of about 1.2 bar and a temperature of 70° C. The second compressor stage hence has a compression ratio of about 0.8 (expansion). The compressed air is conducted from the outlet of the second compressor stage 206 through the aftercooler 208 and is cooled there to about 30° C.

The twin screw compressor 200 described by way of example shows in idling operation a power consumption of 7 kW and supplies a maximum pressure of 1.2 bar. The speed ratio between the compressor stages is about 3.

REFERENCE LIST

01 Compressor system
02 System housing
03 Side walls
04 Bottom
05 Door
06 System components
07 Cooling air channel
08 Inlet opening
09 Outlet opening
10
11 Passage
12 Air water cooler
13 Upper air conducting elements
14 Warm air
15 Blower
16 Cooling air flow
17 Lower air conducting elements
100 Pulsation damper
101 Damper housing
102 Absorber element receiving region
103 Front plate
104 Flange
105
106 Media flow inlet
107 Media flow
108 Absorber elements
109
110 First change region
111 Centering pin
112 First flow chamber
113 Second change region
114 Second flow chamber
115
116 Media flow outlet
117 Resonator chamber
200 Twin screw compressor
201 First compressor stage
202 First direct drive
203 Suction support
204 Intercooler
205
206 Second compressor stage
207 Second direct drive
208 Aftercooler
209 Exhaust valve Various features and advantages of the disclosure are set forth in the following claims.

What is claimed is:

1. A compressor system with a system housing, in which the following are arranged:

heat generating system components, including at least one compressor stage for compressing a gaseous medium;

an air water cooler;

a blower which generates a cooling air flow; and first air conductors, which conduct heated air from the heat generating system components to the air water cooler, wherein a cooling air channel includes a portion partitioned from the heat generating system components, the portion having an inlet opening in an upper section of the system housing and an outlet opening in a lower section of the system housing, wherein second air conductors are positioned in order to conduct the cooling air flow after flowing through the air water cooler to the inlet opening, and wherein third air conductors are positioned in order to conduct the cooling air flow from the outlet opening to the heat generating system components, and wherein the blower is positioned above the air water cooler in order to draw the cooling air flow through the air water cooler and supply it to the inlet opening of the cooling air channel.

2. The compressor system according to claim 1, wherein the portion of the cooling air channel runs at least in sections in a door sealing the system housing.

3. The compressor system according to claim 1, wherein the cooling air channel runs in sections in a bottom of the system housing and has a plurality of outlet openings.

4. The compressor system according to claim 1, wherein the heat generating system components comprise an electronic circuit assembly.

5. The compressor system according to claim 1, wherein the air water cooler is connected to an external cooling circuit having a heat recovery unit.

6. The compressor system according to claim 1, wherein the at least one compressor stage includes a first and a second compressor stage, wherein the first compressor stage compresses the gaseous medium and conducts it to the second compressor stage, which further compresses the medium;

both compressor stages are driven separately from one another and are speed adjustable; and an exhaust valve is positioned at an outlet of the second compressor stage and opened when a volume flow removed from the second compressor stage falls below a predetermined minimum value, wherein the speed of at least the first compressor stage is reduced to a predetermined idling speed (V1L) in order to reduce the volume flow supplied from the first to the second compressor stage.

7. The compressor system according to claim 1, wherein the heat generating system components include a pulsation damper arranged in the system housing, which is arranged in terms of flow to a rear of the last compressor stage, the damper comprising:

a damper housing extending along a central axis and having a media flow inlet and a media flow outlet; and a plurality of sleeve-like absorber elements, each consisting of sound-absorbing material and being arranged concentrically to one another in the damper housing, wherein each sleeve-like absorber element has an inlet region and an outlet region, which are positioned axially spaced from one another, the inlet region of a frontmost absorber element in terms of flow is connected to the media flow inlet of the damper housing, the outlet region of the frontmost absorber element in terms of flow is connected to the inlet region of a subsequent absorber element in terms of flow, and the outlet region of a rearmost absorber element terms of flow is connected to the media flow outlet of the damper housing, and a flow chamber for the media flow is positioned between respective radially adjacent wall sections of different absorber elements.

8. The compressor system according to claim 7, wherein the absorber elements of the pulsation damper are configured to be rotationally symmetrical and engage telescopically.

9. A compressor system with a system housing, in which the following are arranged:

heat generating system components including at least one compressor stage for compressing a gaseous medium;

an air water cooler;

a blower which generates a cooling air flow; and first air conductors, which conduct heated air from the heat generating system components to the air water cooler, wherein a cooling air channel includes an inlet opening in an upper section of the system housing and an outlet opening in a lower section of the system housing, wherein second air conductors are positioned in order to conduct the cooling air flow after flowing through the air water cooler to the inlet opening, wherein third air conductors are positioned in order to conduct the cooling air flow from the outlet opening to the heat generating system components, and wherein the system housing is hermetically sealed from the environment, wherein one of the at least one compressor stage is connected to a suction support open to the environment.

* * * * *